US008104452B2

(12) United States Patent
Bretl et al.

(10) Patent No.: US 8,104,452 B2
(45) Date of Patent: Jan. 31, 2012

(54) METHOD FOR CARRYING OUT A HIGH-PRESSURE START OF AN INTERNAL COMBUSTION ENGINE, CONTROL FACILITY AND INTERNAL COMBUSTION ENGINE

(75) Inventors: Martin Bretl, Bad Abbach (DE); Benoit Chapuis, Regensburg (DE); Martin Cwielong, Regensburg (DE); Matthias Wiese, Aschaffenburg (DE)

(73) Assignee: Continental Automotive GmbH, Hannover (DE)

( * ) Notice: Subject to any disclaimer, the term of this patent is extended or adjusted under 35 U.S.C. 154(b) by 370 days.

(21) Appl. No.: 12/445,096

(22) PCT Filed: Sep. 14, 2007

(86) PCT No.: PCT/EP2007/059694

§ 371 (c)(1),
(2), (4) Date: Apr. 10, 2009

(87) PCT Pub. No.: WO2008/043637

PCT Pub. Date: Apr. 17, 2008

(65) Prior Publication Data

US 2010/0000496 A1 Jan. 7, 2010

(30) Foreign Application Priority Data

Oct. 10, 2006 (DE) ..... 10 2006 047 977

(51) Int. Cl.
*F02D 41/06* (2006.01)

(52) U.S. Cl. ..... 123/491; 123/446; 123/457; 123/511

(58) Field of Classification Search ..... 123/446, 123/447, 457, 464, 510, 511, 435, 491, 198 D; 701/103–105, 107, 113
See application file for complete search history.

(56) References Cited

U.S. PATENT DOCUMENTS

| | | | | |
|---|---|---|---|---|
| 5,394,844 | A | 3/1995 | Akimoto | |
| 5,884,597 | A | 3/1999 | Amou et al. | |
| 6,817,343 | B1 * | 11/2004 | Greco et al. | 123/497 |
| 6,918,367 | B2 | 7/2005 | Denz et al. | |
| 6,990,958 | B2 | 1/2006 | Asano et al. | |
| 7,225,794 | B2 | 6/2007 | Kouketsu et al. | |
| 2002/0043248 | A1 * | 4/2002 | Kojima | 123/456 |
| 2004/0182367 | A1 | 9/2004 | Denz et al. | |
| 2005/0098158 | A1 | 5/2005 | Asano et al. | |

(Continued)

FOREIGN PATENT DOCUMENTS

| | | | |
|---|---|---|---|
| DE | 3304605 | A1 | 8/1983 |

(Continued)

*Primary Examiner* — Hai Huynh
(74) *Attorney, Agent, or Firm* — King & Spalding L.L.P.

(57) ABSTRACT

In known methods for carrying out a high-pressure start of an internal combustion engine, inconvenient starting behavior can sometimes occur. In a method for carrying out a high-pressure start of an internal combustion engine (1), a high-pressure pump (22) is used to feed fuel from a fuel tank (17) to a pressure accumulator (20) and a pressure adjuster (23) is used to control the pressure in the pressure accumulator (20), wherein the high-pressure pump (22) is operated before carrying out a fuel injection into a combustion chamber of the internal combustion engine (1), and the pressure adjuster (23) is activated in such a way that, during the operation of the high-pressure pump (22), the pressure build-up in the pressure accumulator (20) above a pressure limit value pTHRES, upon the exceedance of which the fuel injection is enabled, is delayed.

20 Claims, 4 Drawing Sheets

U.S. PATENT DOCUMENTS

| | | | |
|---|---|---|---|
| 2005/0224051 | A1 | 10/2005 | Fluhrer et al. |
| 2006/0118090 | A1 | 6/2006 | Kouketsu et al. |

FOREIGN PATENT DOCUMENTS

| | | | |
|---|---|---|---|
| DE | 4400449 | A1 | 9/1994 |
| DE | 102004029378 | A | 6/2004 |
| DE | 10301236 | A1 | 7/2004 |
| DE | 102004053580 | A1 | 8/2005 |
| DE | 102005052958 | A1 | 6/2006 |
| EP | 1197649 | A1 | 4/2002 |
| JP | 11270385 | A | 10/1999 |
| WO | WO 03078817 | A1 | 9/2003 |

* cited by examiner

METHOD FOR CARRYING OUT A HIGH-PRESSURE START OF AN INTERNAL COMBUSTION ENGINE, CONTROL FACILITY AND INTERNAL COMBUSTION ENGINE

CROSS-REFERENCE TO RELATED APPLICATIONS

This application is a United States national phase filing under 35 U.S.C. §371 of International Application No. PCT/EP2007/059694, filed Sep. 14, 2007 which claims priority to German Patent Application No. 10 2006 047 977.7, filed Oct. 10, 2006. The complete disclosure of the above-identified application is hereby fully incorporated herein by reference.

TECHNICAL FIELD

The invention relates to a method for carrying out a high-pressure start of an internal combustion engine, a control facility which is embodied so as to enable it to carry out the method, and also to an internal combustion engine with such a control facility.

BACKGROUND

With an internal combustion engine with direct fuel injection the fuel is injected by means of an injection valve directly into the combustion chamber. To start such an internal combustion engine both a low-pressure start and also a high-pressure start can be carried out. With a low-pressure start the fuel is injected at a typical pressure of 5 to 8 bar. At low temperatures in particular this process results in parts of the fuel being deposited onto the cold combustion chamber walls, the so-called wall film. These fuel deposits are involved only partly or not at all in the combustion process. The result is an increase in fuel consumption and emission of pollutants during the start process. For this reason the start process of the internal combustion engine is preferably carried out as a high-pressure start, in which the fuel is injected at a considerably higher pressure, typically 20 to 30 bar, into the combustion chamber. The finer atomization of the fuel significantly reduces the deposition of fuel at lower temperatures, which has a positive effect on the fuel consumption and pollutant emissions. The problem with a high-pressure start however is a sufficiently fast and stable pressure buildup in the injection system, to ensure a rapid start and a stable combustion.

Application DE 10 2004 029 378 A1 has disclosed a method for starting an internal combustion engine in which even before the starter is actuated pressure is built up in the injection system by operation of the fuel pump. It is further proposed in this publication that on actuation of the starter the crankshaft is initially started into rotation without an injection being triggered. The result achieved is that a sufficiently high pressure is built up by means of the fuel pump coupled with the crankshaft before first injection is started.

It is further known that the injection is enabled in the injection system on reaching a pressure threshold value, which indicates that sufficiently high pressure obtains.

Although the known method achieves an early buildup of pressure in the injection system and thereby a rapid enabling of the injection, it can however result after the starting of the first injection in a pressure drop in the injection system and thus to an uncomfortable start behavior of the internal combustion engine.

SUMMARY

According to various embodiments, a method, a control facility and an internal combustion engine can be provided which guarantee improved start behavior during a high-pressure start.

According to an embodiment, in a method for carrying out a high-pressure start of an internal combustion engine, a high-pressure pump is used to convey fuel from a fuel tank to a pressure reservoir and a pressure adjustment means is used for control of the pressure in the pressure reservoir, wherein the high-pressure pump being operated before a fuel injection into a combustion chamber of the internal combustion engine is carried out, and the pressure adjustment means being controlled so that during the operation of the high-pressure pump the pressure buildup in the pressure reservoir beyond a pressure threshold value which if exceeded, causes the fuel injection to be enabled, is delayed.

According to a further embodiment, the pressure adjustment means can be controlled such that during the delay, the pressure p in the pressure reservoir is increased up to a pressure value which lies below the pressure threshold value. According to a further embodiment, the delay may last for a predetermined number of revolution cycles of the internal combustion engine. According to a further embodiment, the delay may last for a predetermined period of time. According to a further embodiment, the delay may last for a predetermined number of working cycles of the high-pressure pump. According to a further embodiment, the duration of the delay can be determined as a function of a temperature. According to a further embodiment, the pressure adjustment means can be controlled after the delay such that the pressure buildup beyond the pressure threshold value is at a maximum.

According to another embodiment, a control facility for an internal combustion engine may comprise a high-pressure pump for conveying fuel from a fuel tank to a pressure reservoir and a pressure adjustment means for controlling the pressure in the pressure reservoir, wherein the control facility is operable to carry out a high pressure start of the internal combustion engine, wherein the high-pressure pump is operated before a fuel injection into a combustion chamber of the internal combustion engine is carried out, and the pressure adjustment means is controlled such that during the operation of the high-pressure pump the pressure buildup in the pressure reservoir is delayed via a pressure threshold value which when exceeded, causes the fuel injection to be enabled.

According to yet another embodiment, an internal combustion engine may comprise such a control facility as described above.

BRIEF DESCRIPTION OF THE DRAWINGS

An exemplary embodiment of the present invention is explained in greater detail below with reference to the enclosed figures. The following drawings are shown in the figures.

DETAILED DESCRIPTION

Figure 1:
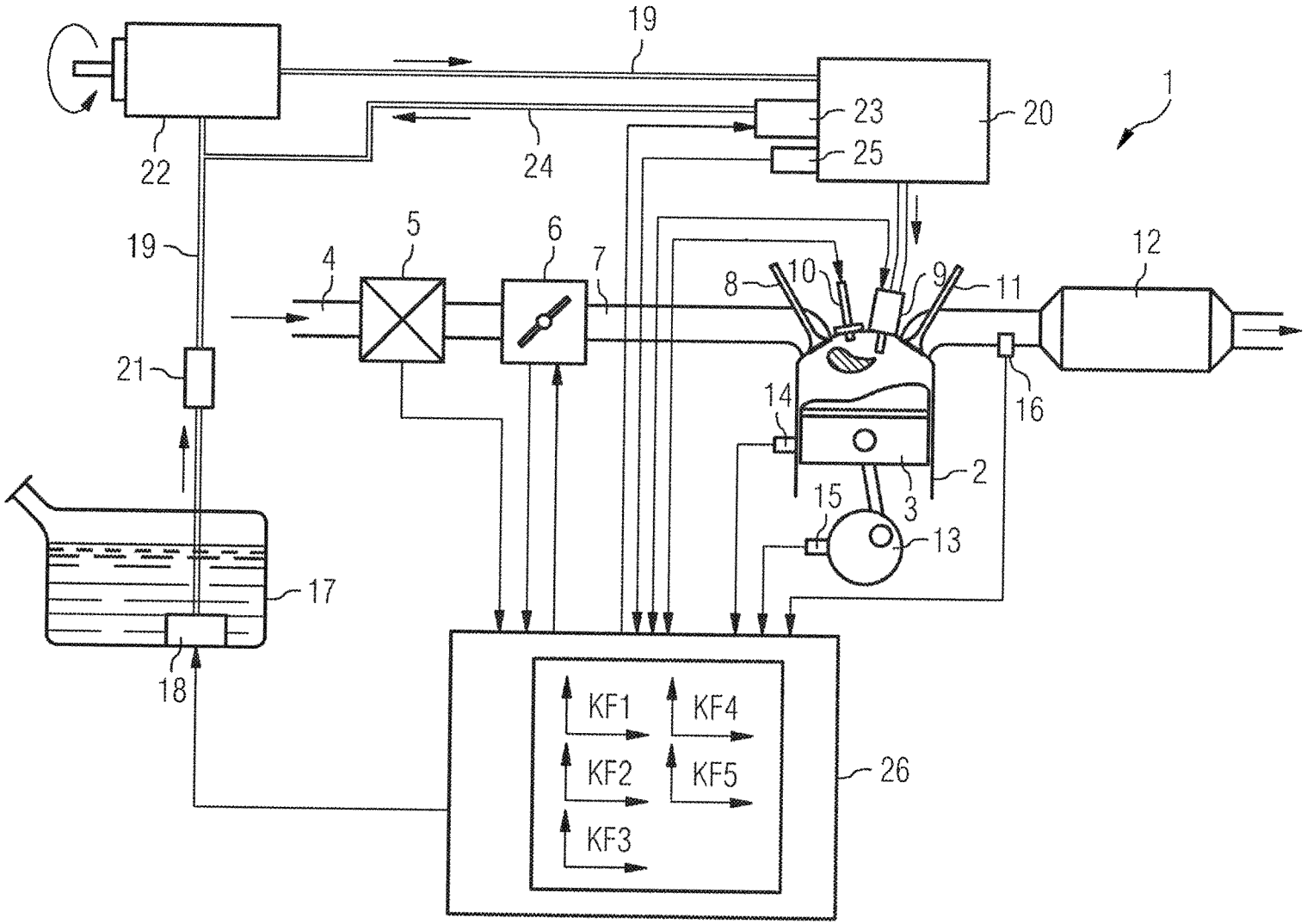
FIG. 1 a schematic diagram of an internal combustion engine.

A method for carrying out a high-pressure start in accordance with an embodiment relates to an internal combustion engine, in which a high-pressure pump is used to convey fuel from a fuel tank to a pressure reservoir and an adjustment means is used to control of the pressure in the pressure reservoir. In accordance with the method the high-pressure pump is operated before fuel is injected into a combustion chamber of the internal combustion engine. The pressure adjustment means is controlled in this case so that, during the operation of the high-pressure pump, the pressure buildup in the pressure reservoir is delayed via a pressure threshold value, which when exceeded causes the fuel injection to be enabled.

The knowledge underlying the various embodiments is that a stable pressure buildup in the pressure reservoir of the internal combustion engine is also conditional on the high-pressure pump being fully ready for operation after an idle phase and able to deliver its full pump power. For example the pump volume of the high-pressure pump must be completely filled with fuel and, especially with high-pressure pumps with hydraulic power transmission, the drive units are also filled with hydraulic fluid. If the high-pressure pump, such as for example with a multi-piston positive displacement pump, has a number of pump units, it can occur that initially only some of the pump units deliver their full power for the reasons given above, so that although a relatively fast buildup of pressure up to above the pressure threshold value is possible, after the first fuel injection however there is a significant pressure drop in the pressure reservoir. In order to prevent this, the pressure adjustment means is controlled in accordance with various embodiments such that during operation of the high-pressure pump the pressure buildup in the pressure reservoir is delayed via the pressure threshold value enabling the fuel injection. This suppresses an early enabling of the fuel injection and the entire power or operational readiness of the high-pressure pump is achieved. In the subsequent buildup of pressure in the pressure reservoir via the pressure threshold value the pressure in the pressure reservoir can be kept particularly stable even after starting the first injections. Sharp drops in the pressure in the pressure reservoir and the associated uncomfortable start behavior can be prevented In an embodiment of the method, the pressure adjustment means is controlled such that during the delay the pressure in the pressure reservoir is increased to a pressure value which lies below the pressure threshold value.

This embodiment of the method offers the advantage that even during the delay a certain buildup in pressure is taking place in the pressure reservoir. Thus the pressure can be increased more quickly after the delay time has elapsed to beyond the pressure threshold value. This makes a very fast enabling of the fuel injection and a faster start of the internal combustion engine possible.

In further embodiments of the method the pressure buildup via the pressure threshold value is delayed by a predetermined number of rpm cycles of the internal combustion engine, by a predetermined period of time or by a predetermined number of operating cycles of the high-pressure pump. In the first case the embodiment is especially directed to internal combustion engines in which the fuel pump is coupled to the crankshaft of the internal combustion engine and is driven by the latter. The other embodiments on the other hand are also applicable to internal combustion engines in which the high-pressure pump has its own drive. In all cases the delay in the pressure buildup can be controlled in a simple manner.

In a further embodiment of the method the duration of the delay is determined depending on a temperature.

The viscosities of the fuel and of the possible hydraulic fluid are temperature dependent. At low temperatures the delay must therefore last longer than at high temperatures.

In a further embodiment of the method, after the delay the pressure adjustment means is controlled so that the pressure buildup via the threshold value is at its maximum.

This embodiment of the method allows a fastest possible rise in pressure in the pressure reservoir to above the pressure threshold value and thereby a fast enabling of the injection. This allows the starting process to be carried out quickly.

A control facility in accordance with another embodiment, is embodied such that it can carry out the above described method. The internal combustion engine in accordance with yet another embodiment includes such a control facility. In both cases the reader is referred to the advantages given with respect to the method.

FIG. 1 shows a schematic diagram of an internal combustion engine 1 with a fuel supply system. For reasons of improved clarity the diagram is depicted very greatly simplified.

The internal combustion engine 1 comprises at least one cylinder 2 and a piston 3 able to be moved up and down in the cylinder 2. The internal combustion engine 1 further comprises an induction tract, in which an air mass sensor 5, a throttle flap 6, as well as a suction tube 7 are arranged downstream of an induction opening 4 for sucking in fresh air. The induction tract opens out into a combustion chamber delimited by the cylinder 2 and the piston 3. The fresh air needed for combustion is introduced via the induction tract into the combustion chamber, with the fresh air supply being controlled by opening and closing an inlet valve 8. The internal combustion engine 1 shown here is an internal combustion engine 1 with direct fuel injection, in which the fuel needed for combustion is injected directly via an injection valve 9 into the combustion chamber . . . . A spark plug 10 also extending into the combustion chamber is used to initiate the combustion. The combustion exhaust gases are discharged via an exhaust valve 11 into an exhaust gas tract 1 of the internal combustion engine 1 and cleaned by means of an exhaust gas catalytic converter 12 arranged in the exhaust gas tract. The power is transferred to a power train of a motor vehicle (not shown) via a crankshaft 13 coupled to the piston 3. The internal combustion engine 1 also has a coolant temperature sensor 14 for detecting the coolant temperature T, a rotational speed sensor 15 for detecting the speed of the crankshaft 13 as well as an exhaust gas temperature sensor 16 for detecting the exhaust gas temperature.

The internal combustion engine 1 is assigned a fuel supply system which features a fuel tank 17 as well as a fuel pump 18 arranged therein. The fuel is fed by means of the fuel pump 18 via a supply line 19 to a pressure reservoir 20. This reservoir is a common pressure reservoir 20 from which the injection valves 9 for a number of cylinders 2 are supplied with fuel under pressure. Also arranged in the supply line 19 are a fuel filter 21 and a high-pressure pump 22. The high-pressure pump 22 serves to supply the fuel delivered by the fuel pump 18 at relatively low pressure (appr. 3 bar) to the pressure reservoir 20 at high pressure (typically up to 150 bar). The high-pressure pump 22 is driven in such cases by means of a separate drive (not shown), for example an electric motor, or by appropriate coupling to the crankshaft 13. For controlling the pressure in the pressure reservoir 20 a pressure adjustment means 23, for example a pressure control valve or a mass flow control valve, is arranged on the reservoir, via which the fuel in the pressure reservoir 20 can flow back via a return flow line 24 into the supply line 19 or the fuel tank 17. A pressure sensor 25 is also provided for monitoring the pressure in the pressure reservoir 20.

The internal combustion engine 1 is assigned a control facility 26 which is connected via signal and data lines to all actuators and sensors. Implemented by software in the control facility 26 are engine-map-based motor control functions (KF1 through KF5). Based on the measured values of the sensors and the engine map-based motor control functions, control signals are sent out to the actuators of the internal combustion engine 1 and of the fuel supply system. Thus the control facility 26 is coupled via the data and signal lines to the fuel pump 18, the pressure adjustment means 23, the pressure sensor 25, the air mass sensor 5, the throttle flap 6, the spark plugs 10, the injection valve 9, the coolant temperature sensor 14, the rotational speed sensor 15 and the exhaust gas temperature sensor 16. Furthermore the control facility 26 is connected to other sensors and actuators not shown in FIG. 1, such as the starter, the gas pedal or ABS sensors.

Figure 2:
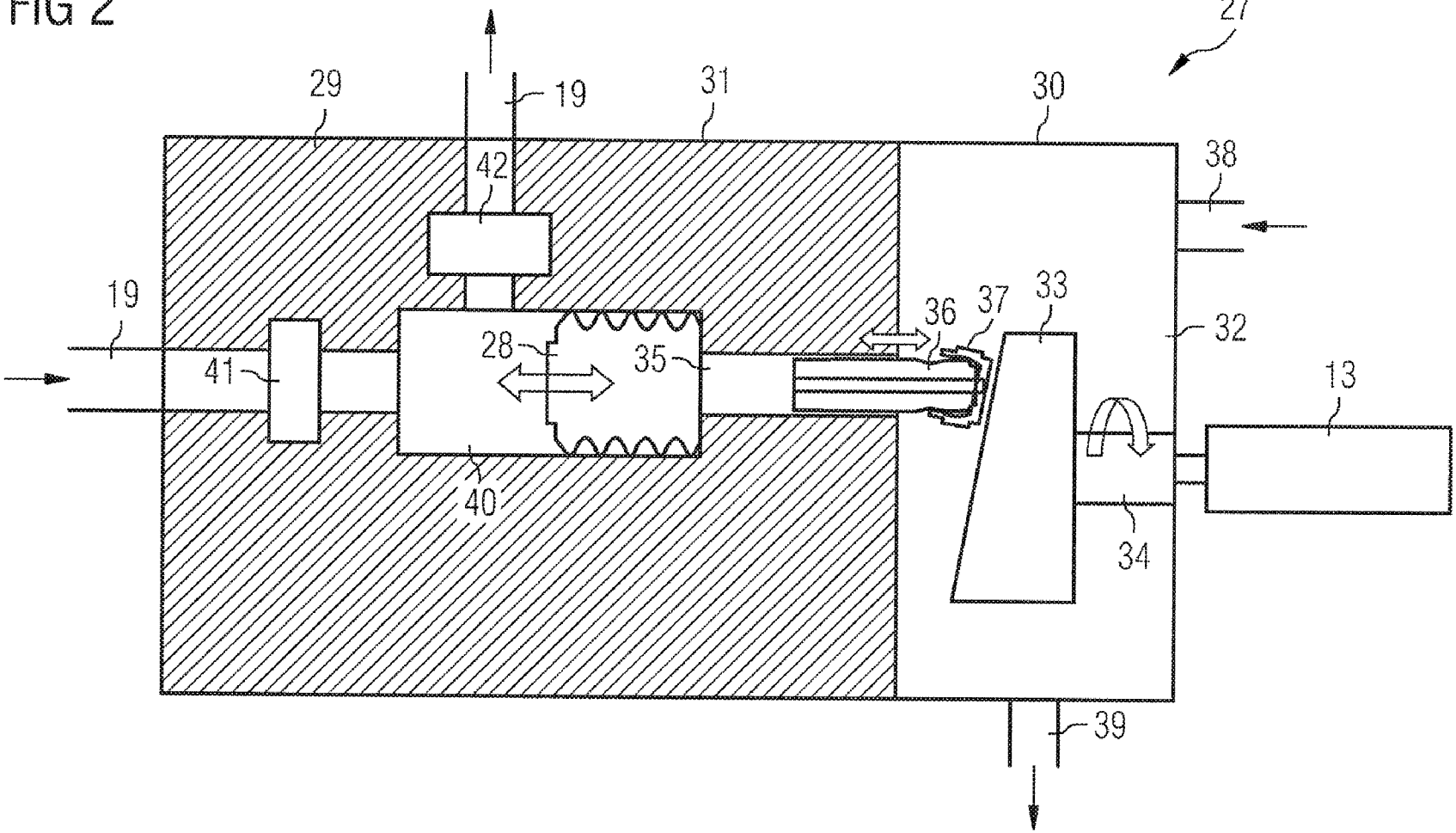
FIG. 2 a schematic diagram of a high-pressure pump for the fuel.

FIG. 2 shows a schematic diagram of an exemplary embodiment of a drive unit 27 of the high-pressure pump 22. The high-pressure pump 22 has two areas separated by a metal bellows 28. These areas are a fuel-side delivery area 29 and an oil-side pump area 30 which are embodied in a housing 31 of the high-pressure pump 22. The oil-side pump area 30 has a drive area, in which a wobble plate 33 is rotatably supported. The wobble plate 33 is coupled via suitable coupling elements, for example a drive belt (not shown) to the crankshaft 13 of the internal combustion engine 1 (only shown schematically here), so that when the crankshaft 13 turns this also leads to the wobble plate 33 turning.

The oil-side pump area 30 further features a cylindrical cavity 35 in which a piston-type plunger 36 is arranged for backwards and forwards movement (double-headed arrow). The cylindrical plunger 36 is connected to a driver element 37 mounted movably on the wobble plate 33 in such a way that a rotation of the wobble plate 33 leads to a backwards and forwards movement of the plunger within the cavity 35. The entire oil-side pump area 30 is filled with an operating oil. The operating oil is directed from a storage container (not shown) via a feed line 38 into the pump area 30 and discharged via a return line 39 back into the storage container. The operating oil serves in this case not only for transmission of the pump energy of plunger 36 to the metal bellows 28 but also guarantees a sufficient lubrication of all moving parts in the oil-side pump area 30.

The fuel-side delivery area 29 has a pump volume 40 in which the metal bellows 28 can contract and expand. The metal bellows 28 serves in this case to securely separate the oil-side pump area 30 from the fuel-side delivery area 29. This ensures that there is no mixing of the operating oil with the fuel. Since the inner chamber of the metal bellows is completely filled with operating oil, this acts as pneumatic fluid, so that the back and forth movement of the piston-like plunger results in a corresponding contraction or expansion of the metal bellows in the pump volume 40.

As has already been explained above, the turning of the crankshaft 13 results in a rotation of the wobble plate 33 and to a back-and-forth movement of the piston-type plunger 36 in the cavity 35 of the pump area. The operating oil acting as pneumatic fluid causes the pump movement of the piston-type plunger 36 in the cavity 35 of the metal bellows 28 within the pump volume in the delivery area 29 to contract and expand. A contraction of the metal bellows 28 (in FIG. 2 in the direction of the arrow to the right) thus results in an induction effect, with fuel being sucked in via the tank-side supply line 19 and an inlet valve 41 into the pump volume 40. In a subsequent expansion of the metal bellows the inlet valve 41 closes and the fuel is fed via a discharge valve 42 and via the pressure reservoir-side supply line 19 at high pressure to the pressure reservoir 20. The high-pressure pump 22 causes the fuel supplied at low pressure by the fuel pump 18 to be fed to the pressure reservoir 20 at high pressure. The pressure reservoir 20 serves in this case as a reservoir for fuel under pressure.

When the internal combustion engine 1 has been standing idle for a long period, the operating oil drains away at least partly from the oil-side pump area 30 via the discharge line 39 into the storage container. It can occur at the same time that fuel flows back from the pump volume 40 into the pump area 30 when the internal combustion engine 1 has been standing idle for a long period either in the direction of the pressure reservoir 20 or in the direction of the fuel tank 17. In this case the pump volume 40 would not be completely filled with fuel. In the previously mentioned case the drive area 32 would not be completely filled with operating oil. With a high-pressure pump 22 with a number of such drive units 27 the result can thus be different fill levels of operating oil in the pump area 30 and fuel in the delivery area 29. In this state the high-pressure pump 22 is not completely ready for operation and does not deliver its full pump power.

In a start process of the internal combustion engine 1 the crankshaft 13 is started into rotation by means of an electrical starter (not shown). The rotation of the crankshaft 13 results in a rotation of the wobble plate in the high-pressure pump 22 and thus in a buildup of pressure of the fuel in the pressure reservoir 20. To carry out a high-pressure start in the internal combustion engine 1 with direct fuel injection, before the start of the first injection into the combustion chamber of the internal combustion engine 1 a pressure threshold value must be exceeded. The pressure in the pressure reservoir 20 is monitored by the control facility 26 by means of the pressure sensor 25. Only when the pressure threshold value is exceeded does the control facility 26 issue a corresponding signal to enable the first injection. The fact that the high-pressure pump 22, as explained above, after the internal combustion engine 1 has been standing idle for a long period, does not immediately produce its full delivery power, means that there is a danger of a delay and an uncomfortable start behavior of the internal combustion engine 1 during high-pressure starting. This problem will be explained in greater detail with reference to FIG. 3A.

Figure 3A:
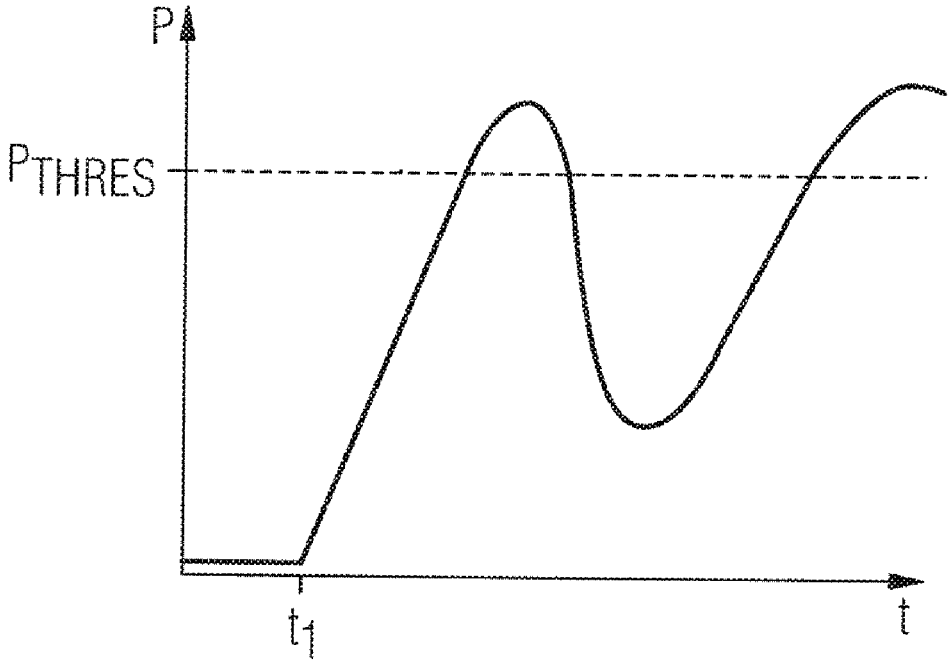
FIGS. 3A and 3B diagrams to show the pressure characteristic in the pressure reservoir during the start process, FIG. 4 a flowchart of a method for carrying out a high-pressure start of the internal combustion engine.

In FIG. 3A the pressure p in the pressure reservoir 20 over time t is shown as a diagram for a method known from the prior art for carrying out a high-pressure start. In accordance with this method, when the crankshaft 13 is started into rotation by the starter at time t1, an immediate buildup of pressure in the pressure reservoir 20 occurs. If the high-pressure pump 22 however has a number of drive units 27, as are typically shown in FIG. 2, these drive units 27 can be filled unevenly with operating oil or with fuel. The result of this can be that, directly after the rotation of the crankshaft 13 by the starter, a sharp increase in pressure in the pressure reservoir 20 beyond the pressure threshold value $P_{THRES}$ and thus a rapid enabling of the first injection initially occurs. Since however at this point in time not all drive units 27 of the high-pressure pump 22 have yet reached their full pump power, immediately after the first injection there is a significant drop in pressure in the pressure reservoir 20. Therefore subsequent injections must be delayed until such time as the pressure p in the pressure reservoir 20 has been built up again to above the pressure threshold value $P_{THRES}$. This leads to uncomfortable starting behavior and to an extended start process.

Figure 3B:
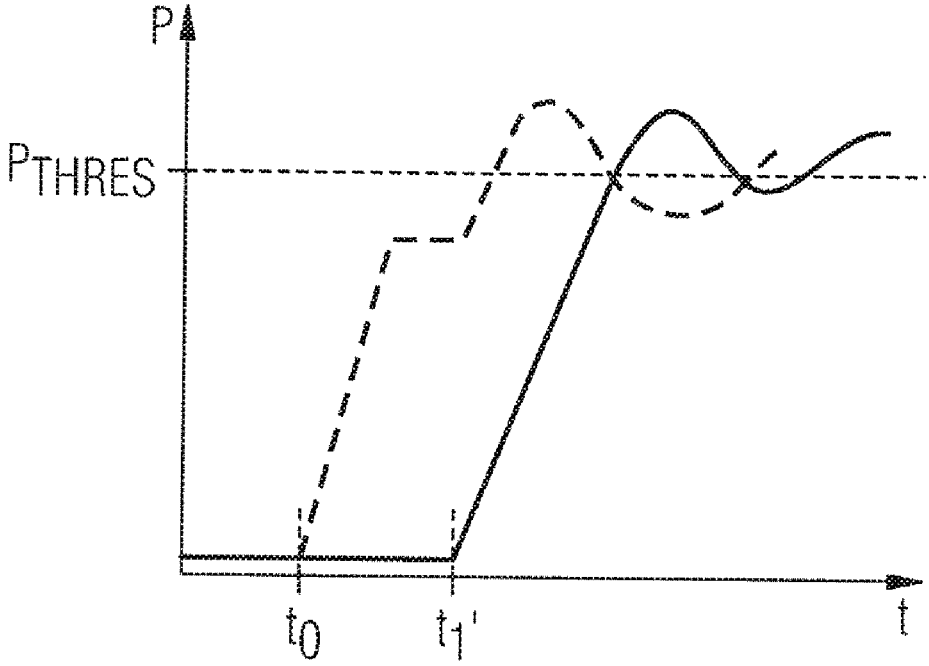
Figure 4:
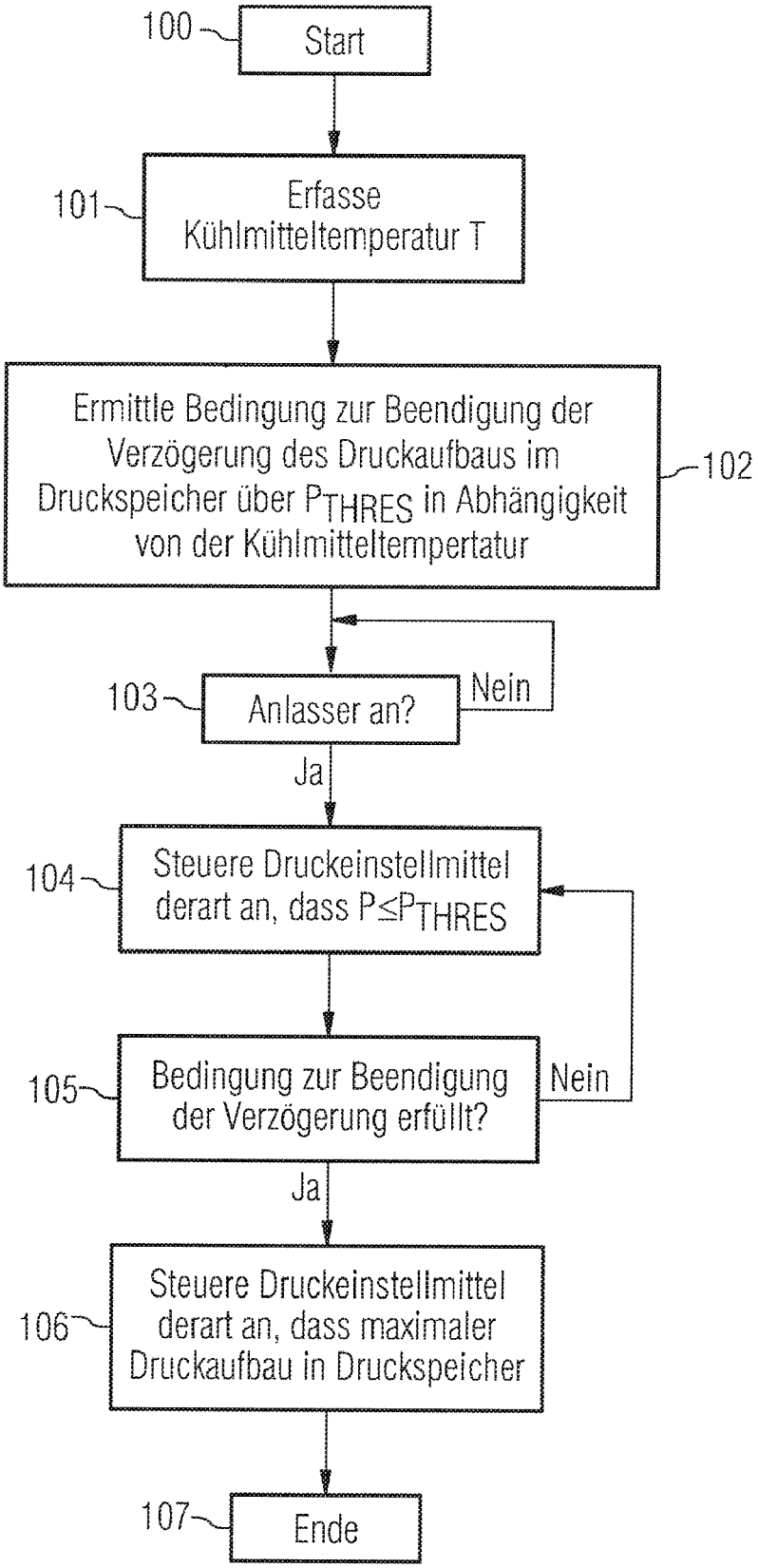

This problem is resolved by the method in accordance with various embodiments. An exemplary embodiment of the method will be explained in greater detail with reference to the flowchart in FIG. 4 in connection with the diagram of FIG. 3B. FIG. 3B shows the pressure p in the pressure reservoir 20 over the time t.

The method will be started in step 100 for example when the ignition of the internal combustion engine 1 is switched on. In a step 101 the coolant temperature T is detected by the coolant temperature sensor 14. Depending on the coolant temperature T determined, in step 102 a condition for ending the delay of the pressure buildup in the pressure reservoir 20 via the pressure threshold value $p_{THRES}$ is determined. This condition is to be understood for example as a predetermined period of time after actuation of the starter, a predetermined number of revolutions of the crankshaft 13 or a certain number of operating cycles of the high-pressure pump 22. The reason for the dependency of the condition on the temperature T is that the viscosity of the operating oil and also of the fuel depend on the temperature. At low temperatures the result is thus a longer delay in the buildup of pressure and at high temperatures a very short or even no delay in the pressure buildup.

In a step 103 the control facility 26 tests whether the starter has been actuated or whether the crankshaft 13 is turning. If this is the case at time t0, the control facility 26 controls the pressure adjustment means 23, i.e. the quantity control valve or the pressure control valve in step 104 such that the pressure in the pressure reservoir 20 remains below the pressure threshold value $p_{THRES}$ until such time as in step 105 the predetermined condition for ending the delay is fulfilled.

After the condition has been fulfilled at time t1' the control facility 26 controls the pressure adjustment means 23 in step 106 so that a maximum pressure buildup in the pressure reservoir 20 via the threshold value $p_{THRES}$ results. This causes the injection to be enabled and the high-pressure start can be begun. The method is ended in step 107.

The delay of the pressure buildup in the pressure reservoir 20 to above the pressure threshold value $p_{THRES}$ results in a delayed enabling of the injection, with all injection valves 9 of the internal combustion engine 1 remaining closed. This is realized by the control facility 26 setting the pressure control valve or the quantity control valve such that there is a resulting return flow of fuel from the pressure reservoir 20 into the supply line 19 or into the fuel tank 17 (see FIG. 1). Since the crankshaft 13 is turned during this delay by the starter, the high-pressure pump 22 is operated, in which all drive units 27 perform at least one working cycle. During the delay there is thus sufficient time for the oil-side pump area 30 and the fuel-side delivery area 29 of all drive units 27 of the high-pressure pump 22 to be completely filled with operating oil or with fuel and thus the high-pressure pump 22 to reach its full operational readiness and delivery power. Only after the condition is fulfilled does the control facility 26 control the pressure adjustment means 23 at point in time t1' such that there is a resulting fast buildup of pressure within the pressure reservoir and a fast enabling of the first injection. The fact that the high-pressure pump 22 has now reached its full operational readiness and delivery power, means that there is also a markedly lower drop in pressure in the pressure reservoir 20 after the first injections have been started, so that the subsequent injections can be carried out quickly and safely. This greatly improves the overall starting behavior of the internal combustion engine 1.

A further embodiment of the method is shown in FIG. 3B as a dashed line. According to this, the control facility 26 can control the pressure adjustment means 23 such that during the delay of the pressure buildup there is a resultant part pressure buildup in the pressure reservoir 20, with the pressure p in the pressure reservoir 20 remaining during the delay below the pressure threshold value $P_{THRES}$. The part pressure buildup gives the advantage that, after the condition for ending the delay is fulfilled, a very fast pressure buildup to above the pressure threshold value $p_{THRES}$ and a fast start of the internal combustion engine 1 is possible.

LIST OF REFERENCE NUMBERS

1 Internal combustion engine
2 Cylinder
3 Piston
4 Suction opening
5 Air mass sensor
6 Throttle flap
7 Suction tube
8 Inlet valve
9 Injection valve
10 Spark plug
11 Exhaust valve
12 Exhaust gas catalytic converter
13 Crankshaft
14 Coolant temperature sensor
15 Rotational speed sensor
16 Exhaust gas temperature sensor
17 Fuel tank
18 Fuel pump
19 Supply line
20 Pressure reservoir
21 Fuel filter
22 High-pressure pump
23 Pressure adjustment means
24 Return flow line
25 Pressure sensor
26 Control facility
27 Drive unit
28 Metal bellows
29 Delivery area
30 Pump area
31 Housing
32 Drive area
33 Wobble plate
34 Coupling element
35 Cavity
36 Plunger
37 Driver element
38 Feed line
39 Discharge line
40 Pump volume
41 Inlet valve
42 Discharge valve

The invention claimed is:

1. A method for carrying out a high-pressure start of an internal combustion engine, in which a high-pressure pump is used to convey fuel from a fuel tank to a pressure reservoir and a pressure adjustment means is used for control of the pressure in the pressure reservoir, wherein the high-pressure pump being operated before a fuel injection into a combustion chamber of the internal combustion engine is carried out, and the pressure adjustment means being controlled so that during the operation of the high-pressure pump the pressure buildup in the pressure reservoir beyond a pressure threshold value which if exceeded, causes the fuel injection to be enabled, is delayed.

2. The method according to claim 1, wherein the pressure adjustment means are controlled such that during the delay, the pressure in the pressure reservoir is increased up to a pressure value which lies below the pressure threshold value.

3. The method according to claim 1, wherein the delay lasts for a predetermined number of revolution cycles of the internal combustion engine.

4. The method according to claim 1, wherein the delay lasts for a predetermined period of time.

5. The method according to claim 1, wherein the delay lasts for a predetermined number of working cycles of the high-pressure pump.

6. The method according to claim 1, wherein the duration of the delay is determined as a function of a temperature.

7. The method according to claim 1, wherein the pressure adjustment means are controlled after the delay such that the pressure buildup beyond the pressure threshold value is at a maximum.

8. A control facility for an internal combustion engine, comprising a high-pressure pump for conveying fuel from a fuel tank to a pressure reservoir and a pressure adjustment means for controlling the pressure in the pressure reservoir, wherein the control facility is operable to carry out a high pressure start of the internal combustion engine, wherein the high-pressure pump is operated before a fuel injection into a combustion chamber of the internal combustion engine is carried out, and the pressure adjustment means is controlled such that during the operation of the high-pressure pump the pressure buildup in the pressure reservoir is delayed via a pressure threshold value which when exceeded, causes the fuel injection to be enabled.

9. An internal combustion engine comprising a control facility as claimed in claim 8.

10. The control facility according to claim 8, wherein the pressure adjustment means are controlled such that during the delay, the pressure in the pressure reservoir is increased up to a pressure value which lies below the pressure threshold value.

11. The control facility according to claim 8, wherein the delay lasts for a predetermined number of revolution cycles of the internal combustion engine.

12. The control facility according to claim 8, wherein the delay lasts for a predetermined period of time.

13. The control facility according to claim 8, wherein the delay lasts for a predetermined number of working cycles of the high-pressure pump.

14. The control facility according to claim 8, wherein the duration of the delay is determined as a function of a temperature.

15. The control facility according to claim 8, wherein the pressure adjustment means are controlled after the delay such that the pressure buildup beyond the pressure threshold value is at a maximum.

16. A system for carrying out a high-pressure start of an internal combustion engine, comprising a high-pressure pump operable to be operated to convey fuel from a fuel tank to a pressure reservoir before a fuel injection into a combustion chamber of the internal combustion engine is carried out and a pressure adjustment means operable to control the pressure in the pressure reservoir such that during the operation of the high-pressure pump the pressure buildup in the pressure reservoir beyond a pressure threshold value is delayed, wherein if the pressure threshold value is exceeded the fuel injection is enabled.

17. The system according to claim 16, wherein the pressure adjustment means are controlled such that during the delay, the pressure in the pressure reservoir is increased up to a pressure value which lies below the pressure threshold value.

18. The system according to claim 16, wherein the delay lasts for a predetermined number of revolution cycles of the internal combustion engine, for a predetermined period of time, or for a predetermined number of working cycles of the high-pressure pump.

19. The system according to claim 16, wherein the duration of the delay is determined as a function of a temperature.

20. The system according to claim 16, wherein the pressure adjustment means are controlled after the delay such that the pressure buildup beyond the pressure threshold value is at a maximum.

* * * * *